US009173529B2

(12) United States Patent
Todokoro

(10) Patent No.: US 9,173,529 B2
(45) Date of Patent: Nov. 3, 2015

(54) BATH CHAIR

(71) Applicant: AGATSUMA CO., LTD., Tokyo (JP)

(72) Inventor: Shinji Todokoro, Tokyo (JP)

(73) Assignee: AGATSUMA CO., LTD., Tokyo (JP)

( * ) Notice: Subject to any disclaimer, the term of this patent is extended or adjusted under 35 U.S.C. 154(b) by 0 days.

(21) Appl. No.: 14/601,602

(22) Filed: Jan. 21, 2015

(65) Prior Publication Data

US 2015/0201814 A1 Jul. 23, 2015

(30) Foreign Application Priority Data

Jan. 21, 2014 (JP) ..... 2014-008386

(51) Int. Cl.

| | |
|---|---|
| ***A47K 3/024*** | (2006.01) |
| ***A47K 3/12*** | (2006.01) |
| ***A47D 1/00*** | (2006.01) |
| ***A47C 1/024*** | (2006.01) |

(52) U.S. Cl.

CPC ..... *A47K 3/127* (2013.01); *A47C 1/024* (2013.01); *A47D 1/002* (2013.01)

(58) Field of Classification Search

CPC ..... A47K 3/122; A47K 3/125; A47K 3/127

USPC ..... 4/572.1–578.1

See application file for complete search history.

(56) References Cited

U.S. PATENT DOCUMENTS

| | | | | |
|---|---|---|---|---|
| 5,317,765 | A * | 6/1994 | Knoedler et al. | 4/572.1 |
| 5,784,728 | A * | 7/1998 | Weddendorf et al. | 4/571.1 |
| 2005/0057083 | A1 * | 3/2005 | Werschmidt | 297/354.13 |

* cited by examiner

*Primary Examiner* — Tuan N Nguyen

(74) *Attorney, Agent, or Firm* — The Marbury Law Group, PLLC

(57) ABSTRACT

A bath chair having a reclining mechanism with enhanced operability and durability. A backrest is rotatable provided to bearing members at a rear of a base, an operating shaft is laid across a back of the backrest, a lever is provided to a center of the operating shaft. The operating shaft is biased so that the lever is pressed downward; abutment members fixed to both ends of the operating shaft and a step member having a plurality of steps provided to a rear of the bearing member abut against each other to support the backrest. When the lever is pulled up, the abutment members are rotated upward, the abutment between the step members and the abutment members are released, and then the backrest can be adjusted its inclination angle.

4 Claims, 11 Drawing Sheets

BATH CHAIR

CROSS-REFERENCE TO RELATED APPLICATION

This application is based upon and claims the benefit of priority under 35 USC 119 of Japanese Patent Application No. 2014-008386 filed on Jan. 21, 2014, the entire disclosure of which, including the description, claims, drawings, and abstract, is incorporated herein by reference in its entirety.

FIELD OF THE INVENTION

The present invention relates to a bath chair for infants. More specifically, the present invention relates to a reclining mechanism of a backrest of a bath chair for infants.

BACKGROUND OF THE INVENTION

Currently, bath chairs are provided for taking care of an infant in a bathroom. These bath chairs comprise a seat having a protrusion at a front center part, a seat back having a reclining mechanism, and a handle provided from side to side above a front side of a seat. Heretofore, various proposals have been made on structures of the reclining mechanism.

For example, Japanese Patent No. 5140839 describes a bath chair that includes a retractable engaging rod at both lower left and lower right sides of a backrest. A base is provided with a plurality of rod holes for engaging with the engaging rod. A pair of operating members for retracting and protruding the each left and right engaging rods is provided to an upper part of a back side of the backrest where respectively correspond to the each left and right engaging rods. The operating member and the engaging rod are connected by an engaging member which is formed extending to perpendicular direction. The engaging member is biased toward a direction in which the engaging rod protrudes. In order to perform a reclining operation, the pair of operating members is pinched against bias force of the engaging member so as to retract the engaging rod. Next, an inclination angle of the backrest is changed with the operating members pinched (engaging rods retracted, in other words) so that the engaging rod aligns with a desired rod hole. By releasing the pinched operating members at the inclination angle in which the engaging rod aligns with the desired rod hole, the engaging rod protrudes to engage with the desired rod hole, whereby the backrest is fixed.

A reclining mechanism described in Japanese Patent No. 5140839 has a certain perpendicular distance between the operating member and the engaging rod. Accordingly, when the pair of operating members is pinched in order to retract the engaging rods, rotational force is generated around a position where a lower portion of the operating member intersects with an axis line of the engaging rod, and is applied to the connecting member for connecting the engaging rod and the operating member. The rotational force makes parallel movement of the engaging member in lateral direction difficult, although the connecting member should move parallel in lateral direction. This interferes with transmission of a pinching force on the operating members to elastic members directly. Consequently greater force is required for retracting the engaging rods relative to elastic force of the elastic member; hence the reclining operation cannot be performed easily with one hand.

SUMMARY OF THE INVENTION

According to an aspect of the invention, there is provided a bath chair including: a base having a seat; a backrest rotatably supported by left and right bearing members each protrudes from rear left and right sides of the base; an operating shaft rotatably laid across a back face of the backrest; a lever provided on a axis of the operating shaft; an abutment member fixed on each end of the operating shaft and which have an abutment part extending orthogonally to the operating shaft; an elastic member for energizing the operating shaft to a direction in which the lever is rotated downward; and a plurality of steps formed at a back side of each bearing members of the base so as to be abuttable against the abutment part of each abutment member.

According to the other aspect of the invention, there is provided the bath chair further including: a latching projection projecting from the abutment part of each abutment members toward front direction; and a latching hole formed on a front side wall surface of a topmost step of each plurality of steps so as to be latchable to the latching projection.

According to another aspect of the invention, there is provided the bath chair, wherein a flat portion is formed on a distal end of the abutment part of each abutment members and the plurality of steps is made up of three steps, a top step, a middle step, and a bottom step and further the top step and the bottom step are formed into flat surfaces, and the middle step is formed into an inclined surface which inclines downward toward rear direction.

As described above, the bath chair of the present invention is made such that the abutment members are individually fixed to the each both ends of the operating shaft, and the backrest is supported by the abutment member and one of the steps formed at the back side of the bearing member abutting against each other. The plurality of steps is provided so that an inclination angle of the backrest can be adjusted to positions corresponding to the each step. The lever is provided to the operating shaft and is energized to the direction in which the lever is rotated downward. Consequently, reclining operation can be performed by the lever being pulled up against the energizing force of the operating shaft so as to rotate the operating shaft, whereby abutment between the abutment member and one the steps is released. This means that the reclining operation can be performed with ease by operating the lever in one direction. In addition, the operating shaft rotates smoothly when the reclining operation is performed since a direction of force for pulling up the lever and a direction of rotation of the operating shaft coincide with each other. Further, according to a structure of the present invention, the backrest can be raised by simply raising the backrest by hand without operating the lever only in a raising direction of the backrest.

The latching projection is provided to the abutment member, and the latching hole is formed on the front side wall surface of the topmost step of the plurality of steps so as to be latched with the latching projection. In performing the reclining operation by raising up the backrest, when the abutment member reaches the topmost step, the latching projection of the abutment member is latched to the latching hole formed on a front side wall surface of the topmost step, whereby further rotation of the backrest is restricted. Unintentional forward folding of the backrest is thus prevented.

A flat portion is formed on a distal end of the abutment member. The each plurality of steps is made up of three steps, the top step, the middle step, and the bottom step. The top step and the bottom step are formed into flat surfaces, and the middle step is formed into the inclined surface which inclines downward toward rear direction. By doing this, the abutment member abuts on the step in surface to surface contact, whereby the backrest can be supported by the abutment member more stably. In addition, posture of an infant can be changed such as from seating to laying or vice versa with ease.

BRIEF DESCRIPTION OF THE SEVERAL VIEWS OF THE DRAWINGS

FIG. 4A shows a high position, FIG. 4B shows a middle position, and FIG. 4C shows a low position.

DETAILED DESCRIPTION OF THE PREFERRED EMBODIMENT

Embodiments of the present invention will be described with reference to FIGS. 1 to 9.

Figure 1:
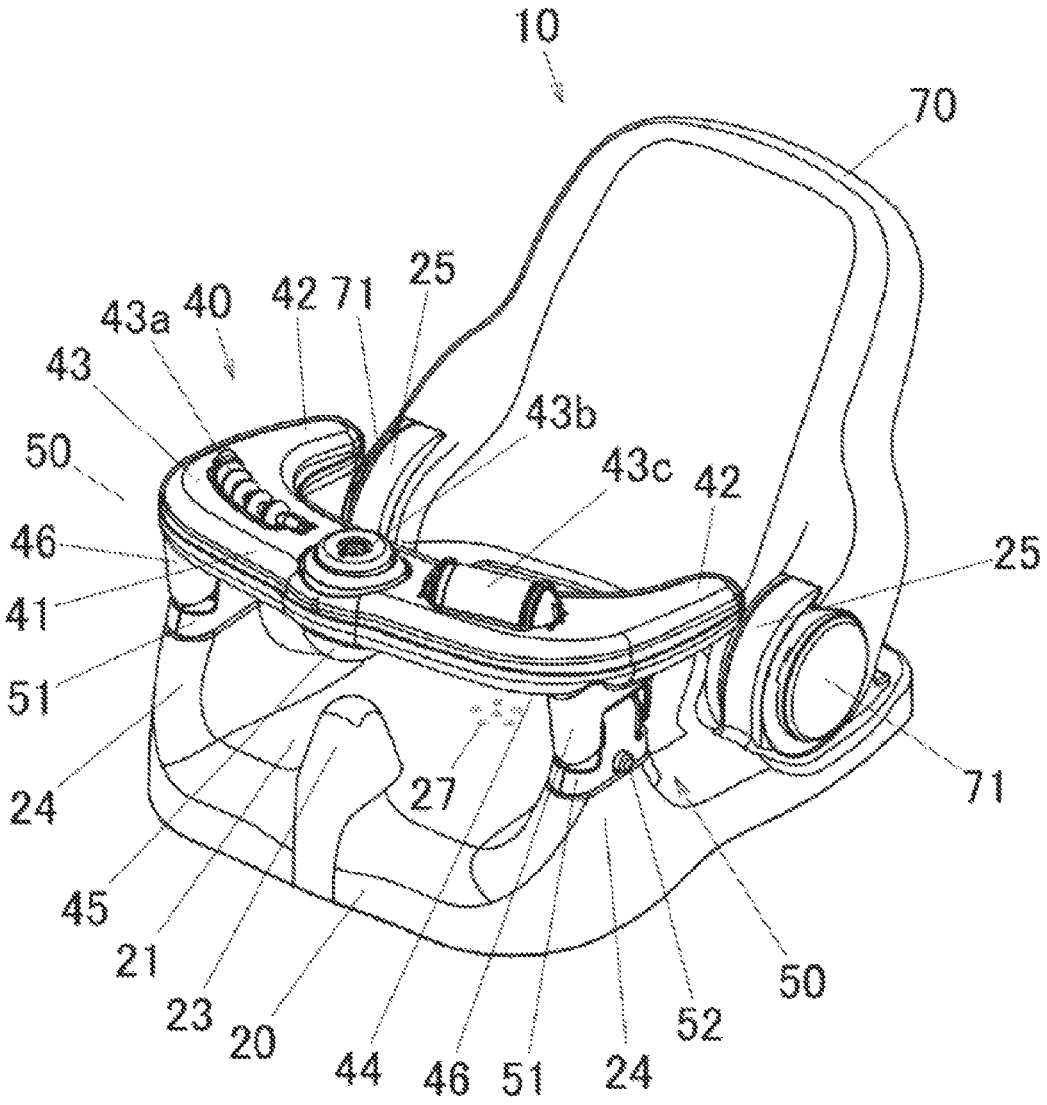
FIG. 1 is a front perspective view of the bath chair of the present invention.

FIG. 1 is a front left perspective view of a bath chair 10, according to the present invention, having a handle for a bath chair. In descriptions hereinafter, a handle 40 side of the bath chair 10 is referred to as front, and a backrest 70 side is referred to as rear. Similarly, when viewed from a user's perspective on the bath chair 10, a left hand side is referred to as left, a right hand side is referred to as right, a seat 21 side on a base 20 of the bath chair 10 is referred to as top, and a reverse side of the top is referred to as bottom.

The bath chair 10 includes the base 20 on a top surface of which the seat 21 is formed, a backrest 70 which is connected rotatably to the base 20, and a handle 40 provided laterally in a front upper space of the base 20. A plurality of holes 27 is provided substantially in a center of the seat 21. The plurality of holes 27 prevents water from pooling on the seat 21 when bathing. A protrusion 23 is formed into a mountain shape at a front center of the seat 21. Support parts 24 are individually formed at each front left and right sides of the seat 21 in such a manner that the support part 24 rises in front-to-rear direction when being viewed down from the upper space above the seat 21.

A handle 40 is provided above a front space of the seat 21 in such a way as to extend between the support parts 24. A handle body 41 of the handle 40 extends from left to right and a front side of the handle body 41 is gradually bent into a convex shape projecting toward front. Each side end of the handle body 41 is extended to project rearward so as to continuously form a rearward projection 42. Consequently, an infant sitting on the seat 21 is surrounded by the handle body 41 and the each rearward projection 42 so as to restrict his/her front side, left side and right side.

Toys 43*a*, 43*b*, 43*c* are disposed on a top surface 43 of the handle body 41 so that the infant can play with while sitting. The toy 43*a* is a marbles-like toy which is made up of multiple rings supported by a supporting bar. The toy 43*b* includes a rotating base having a perpendicular rotational axis. When a doll or the like is fixedly installed on the rotating base, the doll or the like can be rotated about the perpendicular rotational axis. The toy 43*c* includes a cylindrical drum having substantially a lateral rotational axis. Popular characters from animation or TV programs are printed on the cylindrical drum and the infant can play by rotating the cylindrical drum by his/her hand.

A protrusion 45 is formed into a mountain shape at a center of a bottom surface 44 of the handle 40 so as to rise downwardly. The protrusion 45 is formed so as to face the protrusion 23 formed on the seat 21. The protrusions 23 and 45 prevent the infant from slipping forwardly off of the bath chair 10 since the infant sits straddling the protrusions 23 and 45.

The handle 40 is detachably attached to the base 20 and supported upwardly swingable in a clockwise direction or in counterclockwise direction by handle release/support mechanisms 50, 50 provided to each both sides of the bottom surface of the handle 40. Bearing members 46, 46 are individually formed on each both sides of a bottom surface of the handle body 41 at each positions where face the each support parts 24, 24, so as to project downward from the bottom surface of the handle body 41. The bearing member 46 is formed into an inverted U-shape, whose front and rear portions extend downward. A connection member 51 is rotatably connected to the bearing member 46 in such a way that a center upper portion of the connection member 51 is inserted into a center recessed portion of the inverted U-shape of the bearing member 46. A lower portion of the connection member 51 is detachably attached to the support part 24. A release push button 52 is projectingly formed on an outer side surface of the connection member 51. Pressing the release push button 52 detaches the connection member 51 from the support part 24.

A backrest 70 is provided to a rear of the base 20. The backrest 70 is formed so as to have a gradual concave curve extending from a center to left and right so that the infant can lean back on the backrest 70 stably. At each of lower ends of both sides in a left-right direction of the backrest 70, axle portions 71, 71 are individually provided and the axle portions 71, 71 are made two-pronged like an inverted U-shape when viewed from the front of the backrest 70 and individually have openings which cut through between two-prongs and in a front-back direction of the axle portions 71, 71. bearing members 25, 25 are individually formed at each both side of a rear of the base 20, and the bearing member 25, 25 are made to be a substantially circular shape when viewed from a side and project from each rear side ends of the base 20. The each bearing members 25, 25 projecting from the base 20 are individually inserted into the openings between two prongs of the axle portions 71, 71. An inside and outside surfaces of the bearing member 25 projecting from the base 20 slidingly contact inside surfaces of the two-prongs of the axle portion 71, and the axle portion 71 is rotatably supported by the bearing member 25 at an inside and outside surfaces of the bearing member 25.

Figure 2:
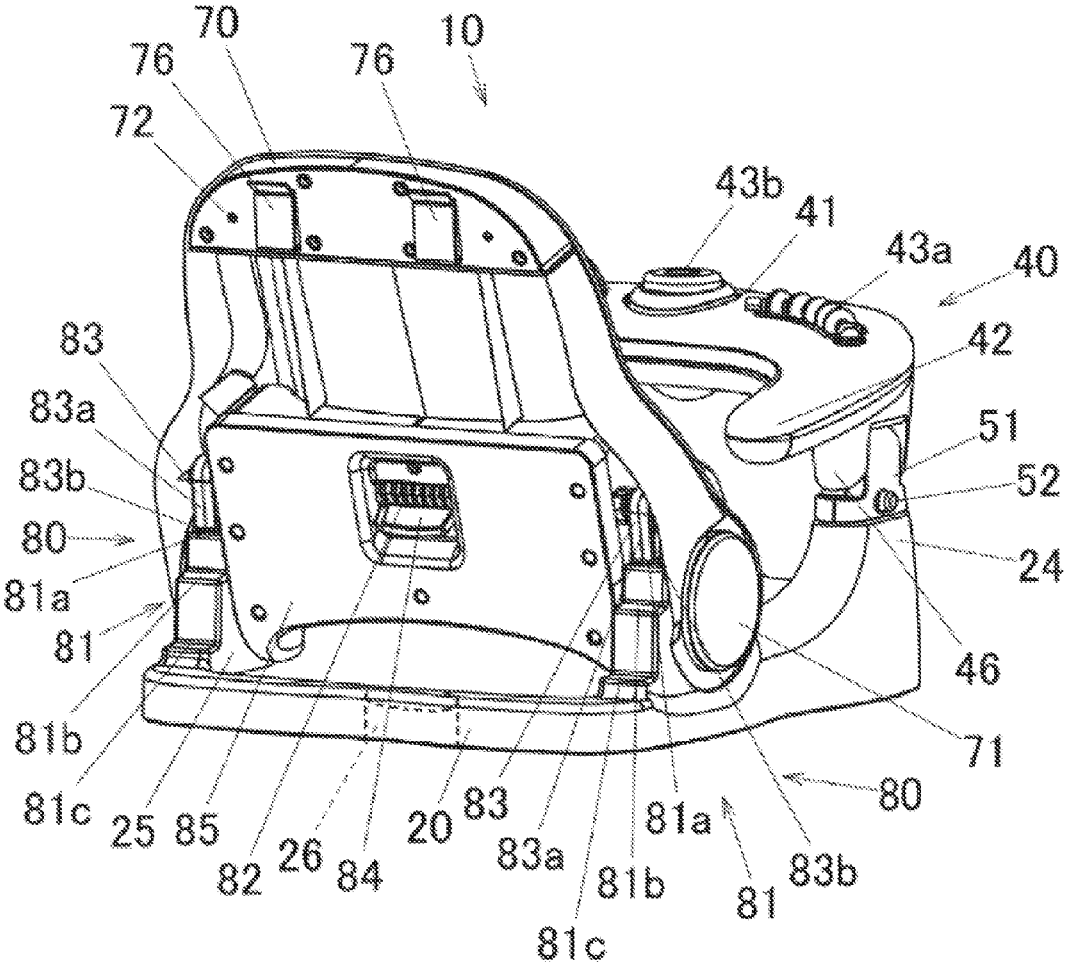
FIG. 2 is a rear perspective view of the bath chair of the present invention.

FIG. 2 is a rear right perspective view of the bath chair of the present invention. A reclining mechanism 80 is provided to a backside of the backrest 70. The backrest 70 can be reclined at three predetermined angles by the reclining mechanism 80.

A step member 81, which includes three stair-like steps, is formed on a backside of the bearing member 25 of the base 20. The step member 81 corresponds to the three predetermined angles of the backrest 70 adjusted by the reclining mechanism 80. A top step 81*a* is a highest step and corresponds to a state in which the backrest 70 is at the highest position. A middle step 81*b* and a bottom step 81*c* are formed in sequence along from top to bottom.

An operating shaft 82 is rotatably laid across the backrest 70 at slightly lower position from a center in a vertical direction of a back face of the backrest 70. Abutment members 83, 83 are respectively provided in a fixed manner to each both ends of the operating shaft 82. Therefore the operating shaft 82 and the abutment member 83 rotate integrally. An abutment part 83*a* is formed on the abutment member 83 so as to extend to a direction which is intersected with a shaft center of the operating shaft 82 at a right angle. A flat portion 83*b* is formed on a distal end of the abutment part 83*a*. The backrest 70 is supported by the flat portion 83*b* and the step member 81, which abut against each other.

A lever 84 is provided to a center of the operating shaft 82. A cover 85 covers the remaining portions of the operating shaft 82 other than portions to which the lever 84 and the each abutment member 83 are provided. An elastic member provided to an interior of the cover 86 biases the operating shaft 82 toward a direction in which the lever 84 is pressed down (in other words, in counterclockwise direction when viewed from right side). The operating shaft 82 is rotatably supported by a bearing member (not shown) formed by the cover 85 and the back face of the backrest 70. Consequently, pulling up the lever 84 against the bias force to the operating shaft 82 rotates the abutment members 83, 83 backward, whereby abutments between the abutment members 83, 83 and the step members 81, 81 are released, and then, the backrest 70 can be adjusted its reclining angle.

A top end cover 72 is provided to a top end part of the back face of the backrest 70. On a surface of the top end cover 72, two hooks 76 are provided. The each hook 76 is formed by bending a plate-like member. Free ends of the plate-like member are formed to be biased so as to close a gap therebetween. The each hook 76 is disposed so that its free end side is oriented upwardly. Usage of the hooks 76 is that one end of a towel (not shown) is inserted into gaps of the free ends of the two hooks 76, and the other end of the towel is extended over the top end of the backrest 70 to a vicinity of a front end of the seat 21. By doing this, the infant does not feel coldness of the backrest 70 and the seat 21, and is prevented from slipping forwardly when he/she is naked and sits on the bath chair 10 for bathing since the backrest 70 and the seat 21 are covered by the towel. The free end on the rear side of each hook 76 is bent toward gap-opening direction for facilitating insertion of the towel. In addition, a grip 26 is formed at a rear center of the base 20 by making a laterally elongated through hole.

Figure 3:
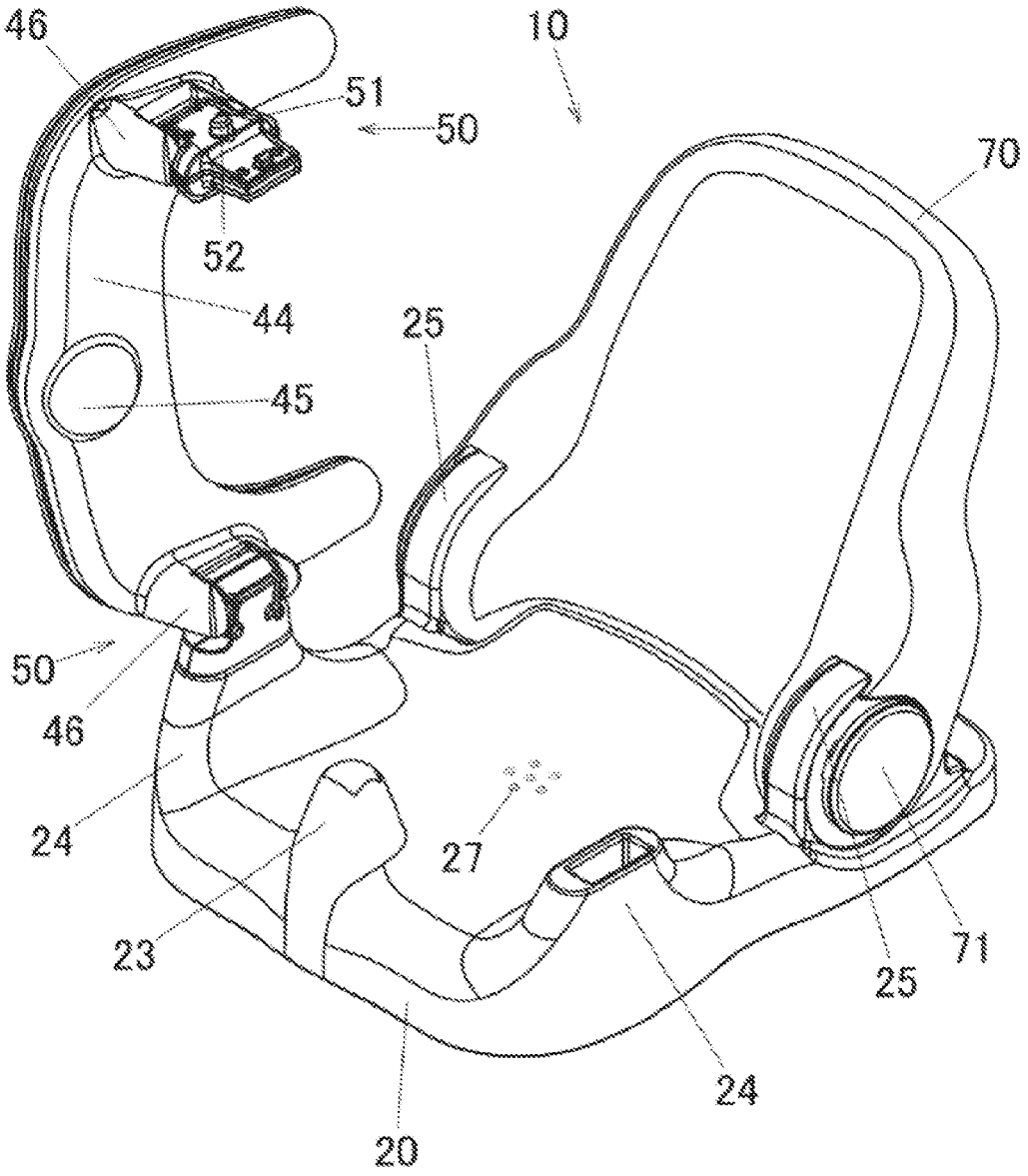
FIG. 3 is a front perspective view of the bath chair of the present invention showing a state in which the handle is opened.

Next, opening and closing operations of the handle 40 of the bath chair 10 will be described with reference to FIG. 3. FIG. 3 is a front left perspective view of the bath chair showing a state in which the handle 40 is opened. In order to open the handle 40 as shown, press either one of the two release push buttons 52 (left side button in this embodiment). By doing this, the connection member 51 is in a state in which the connection member 51 can be detached from the support part 24. Now, the handle 40 can be opened by lifting it up with being swung about the bearing member 46 for supporting the handle 40 on a different side, whereby an open space can be secured above the seat 21. The opening and closing operations can be conducted at either one of both left and right connection members 51. Therefore the handle 40 can be opened to both left and right sides of the base 20. In addition, the handle 40 can be removed from the base 20 by pressing the both left and right release push buttons 52 simultaneously.

Figure 4A:
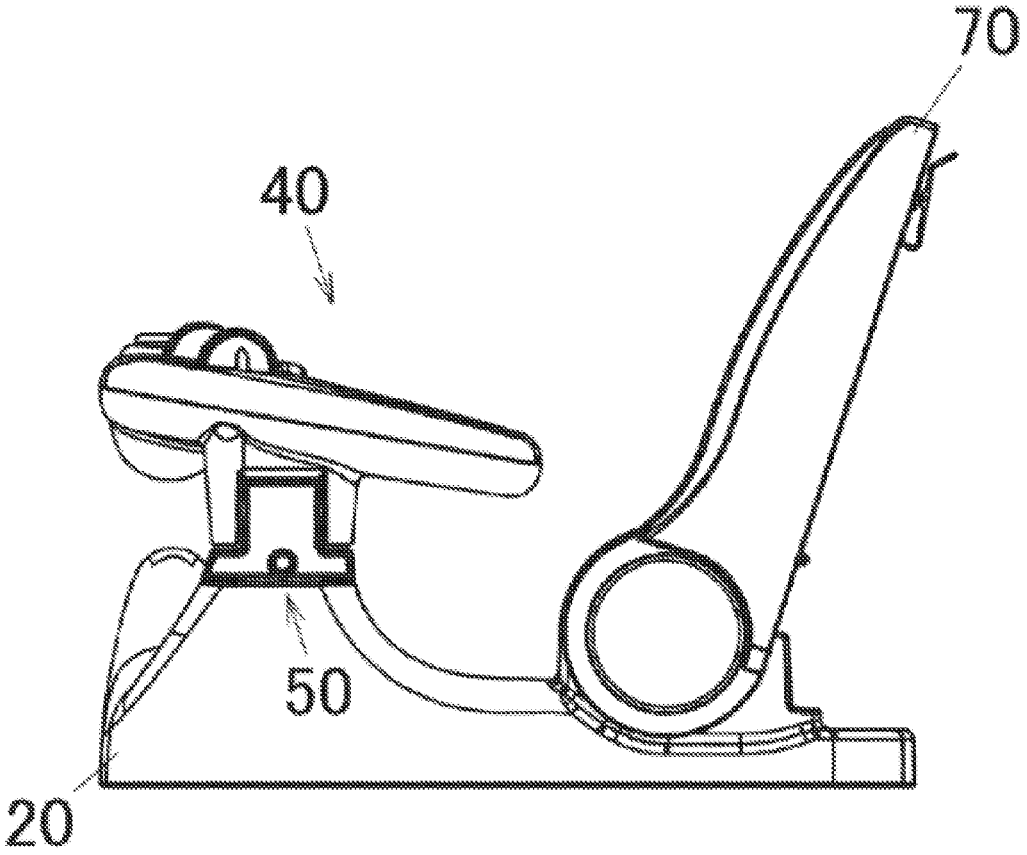
FIGS. 4A-4C are side views of the bath chair of the present invention showing how a reclining system works.
Figure 4B:
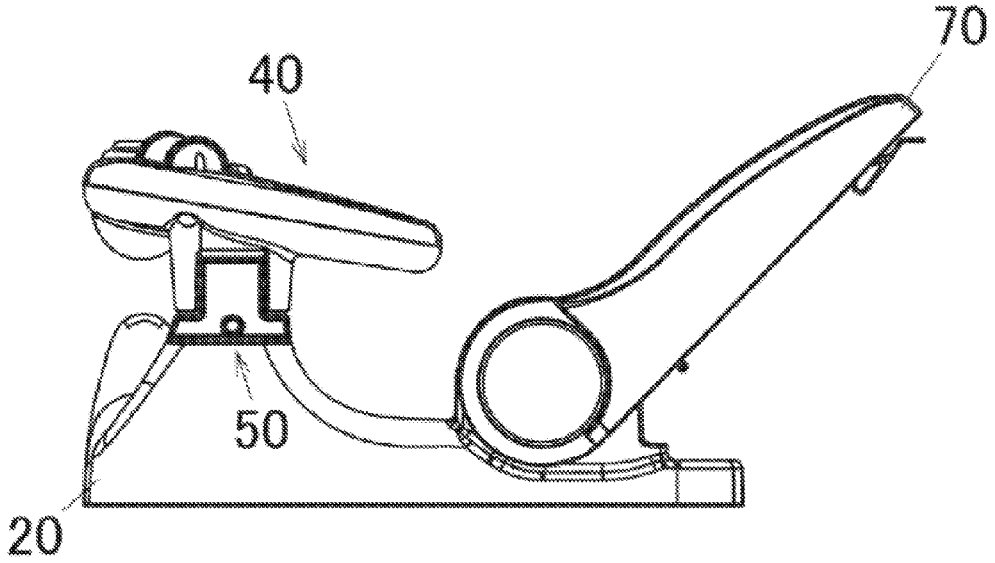
Figure 4C:
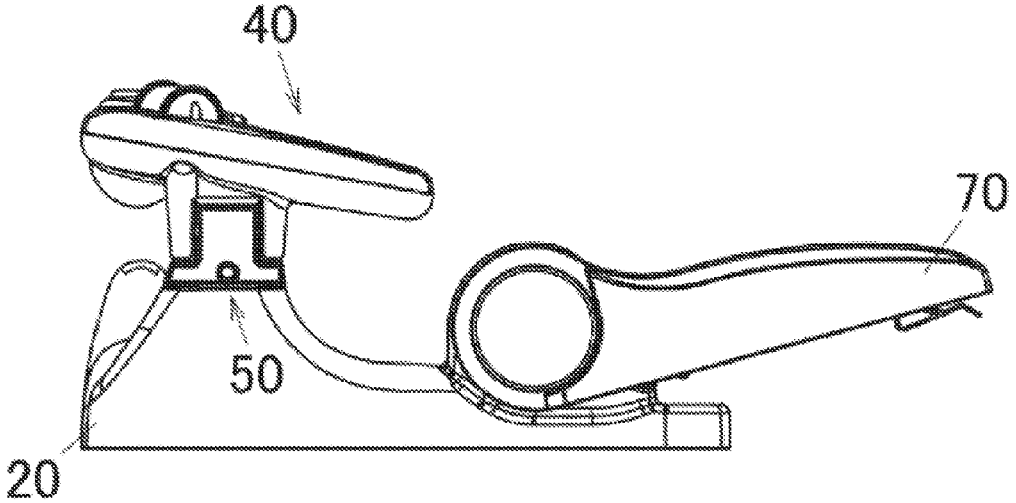

Further, reclining operation of the backrest 70 of the bath chair 10 will be described with reference to FIGS. 4A-4C. In order to adjust the reclining angle, pull up the lever 84 provided to the back face of the backrest 70 so as to rotate the abutment member 83, and then choose a preferred step of the step member 81 to which the abutment member 83 abuts. FIG. 4A shows a condition in which the abutment member 83 abuts against the top step 81*a*. The backrest 70 is at the highest position. An inclination angle of the backrest 70 from a floor is between 65 degrees and 75 degrees. FIG. 4B shows a condition in which the abutment member 83 abuts against the middle step 81*b*. The inclination angle of the backrest 70 from the floor is between 40 degrees and 50 degrees. FIG. 4 C shows a condition in which the abutment member 83 abuts against the bottom step 81*c*. The inclination angle of the backrest 70 from the floor is between 10 degrees and 15 degrees. By doing as such, the inclination angle of the backrest 70 of the bath chair 10 can be adjusted to three positions.

Figure 5:
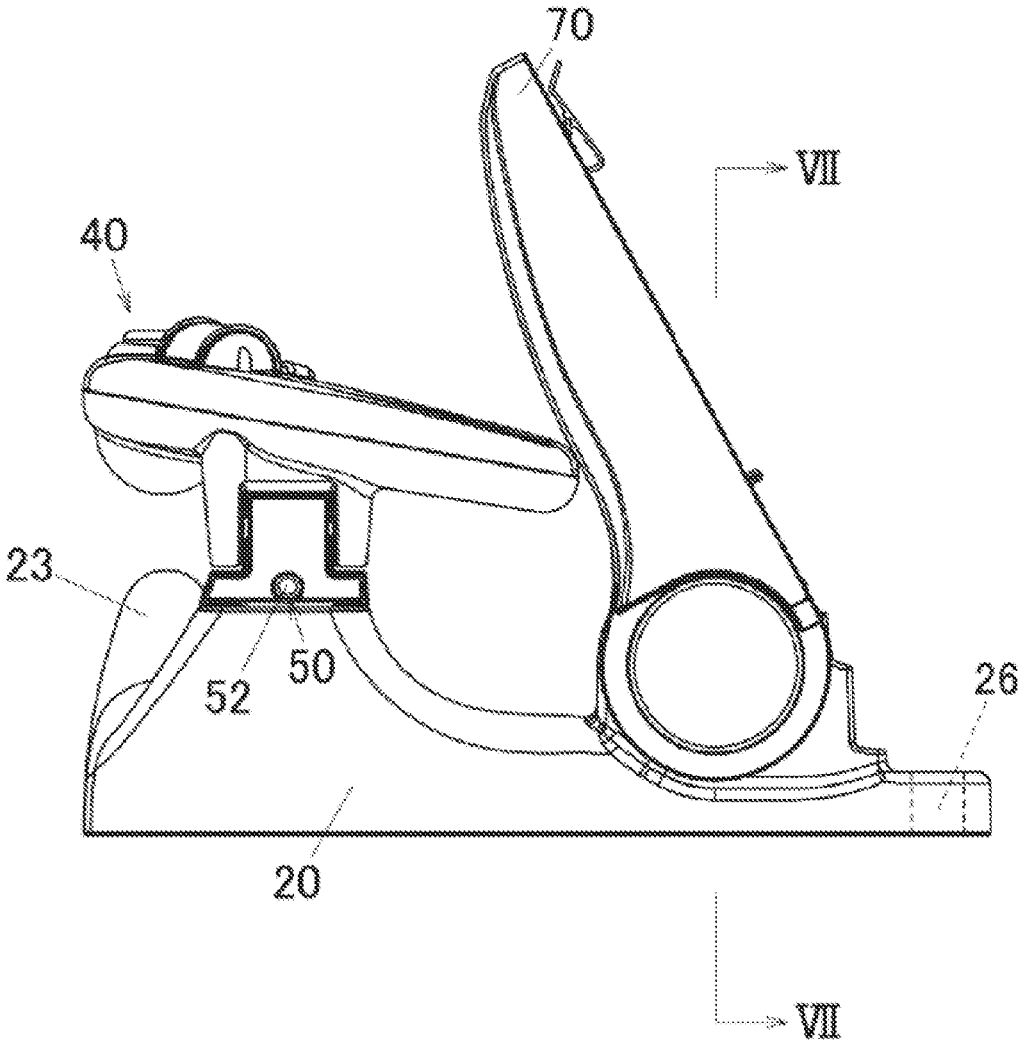
FIG. 5 is a side view of the bath chair of the present invention in a stored position.

A storage condition of the bath chair 10 will be described with reference to FIG. 5. The backrest 70 can be folded forward by pulling up the lever 84 provided to the back face of the backrest 70 when the bath chair 10 is stored. The bath chair 10 can be made compact for easier storage by folding the backrest 70 until it contacts the handle 40 lightly, as shown in FIG. 5.

Figure 6:
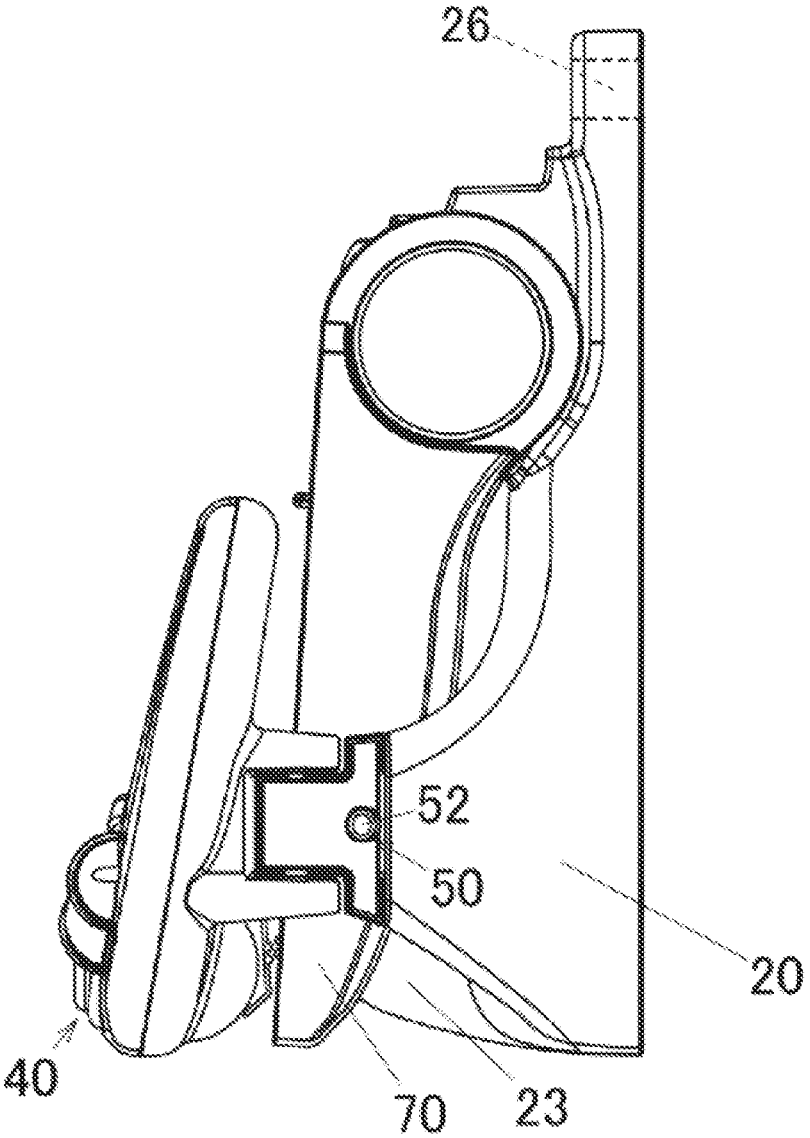
FIG. 6 is a side view of the bath chair of the present invention in a vertically stored position.

Alternatively, the bath chair 10 can also be stored with the bath chair being placed vertically, as shown in FIG. 6. Namely, the backrest 70 of the bath chair 10 can be folded until its front top end lightly contacts the protrusion 23 if the handle 40 is removed from the base 20 by pressing the both left and right release push buttons 52 simultaneously. In addition, by re-installing the handle 40 to the base 20 with the backrest 70 and the protrusion 23 contacting each other, the backrest 70 can be stored with its backward rotation being restricted by the handle 40. Consequently, the backrest is prevented from rotating to open unintentionally. The bath chair 10 can be placed with the handle 40, backrest 70, a front end of the base 20 being oriented downward, and with the grip 26 being oriented upward. By doing this, the bath chair 10 can be stored compactly even in a small bathroom. Further, the vertical position of the bath chair 10 facilitates an easy gripping of the grip 26, and thereby facilitates an easy carry of the bath chair 10.

Figure 7:
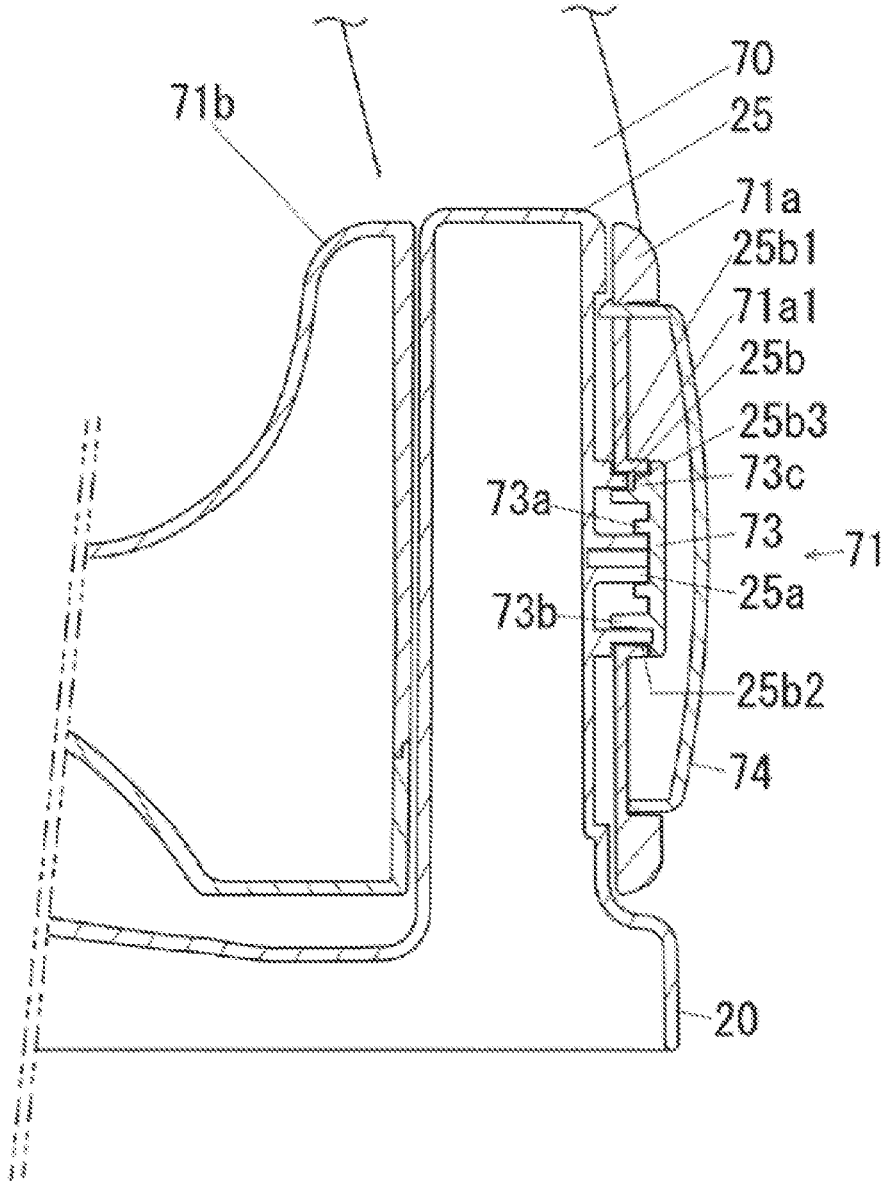
FIG. 7 is a cross-sectional view of a principal part of the bath chair of the present invention taken along line VII-VII of FIG. 5.

Next, a structure in which the backrest 70 is rotatably supported by the bearing member 25 of the base 20 is described. FIG. 7 shows the principal part of the cross-sectional view taken along line VII-VII of FIG. 5. An axle 71 provided to each lower left and lower right sides of the backrest 70 is formed into an inverted U-shape having an outer axle part 71*a* and an inner axle part 71*b*. The bearing member 25 of the base 20 is inserted between the outer axle part 71*a* and the inner axle part 71*b* in such a manner that the bearing member 25 protruding from the base 20 is nipped by the outer axle part 71*a* and the inner axle part 71*b*. A support pin 25*a* is provided to an outer side surface of the bearing member 25 toward outer side in a standing manner. A bearing ring 25*b* is formed so as to project annularly toward outer side on the periphery of the support pin 25*a*. A step portion 25*b*1 is formed annularly on an outer periphery of the bearing ring 25*b*. A sliding annular section 25*b*2 which is a part of the outer periphery of the bearing ring 25*b* is formed as an annular sliding surface on a wall surface so as to stand from the step portion 25*b*1 toward outer side. Two cutout portions 25*b*3 are provided to two portions in an up-down direction of the bearing ring 25*b* so as to face each other by cutting out the bearing ring along an axis thereof. FIG. 7 shows the cutout portion 25*b* of an upper side only.

A cylindrical portion 71*a*1 is formed on the outer axle part 71*a* toward outer side in standing manner. An interior wall surface, which is in a center side of the cylinder, of the cylindrical portion 71*a*1 slides on the sliding annular section 25*b*2. An inner side surface of the cylindrical portion 71*a*1 is formed abuttable against the step portion 25*b*1. This restricts the axle 71 from moving inward. Meanwhile, a stopper 73 formed in a disc shape is disposed to the outer side of the cylindrical portion 71*a*1. A first annular projection 73*a*, and a second annular projection 73*b* are formed concentrically on an inner side of the stopper 73 in such a manner that the both annular projections 73*a*, 73*b* project inward annularly, and the second annular projection 73*b* is formed larger in diameter than the first annular projection 73*a*. Two key-like projections 73*c* for fitting into the cutout portions 25*b*3 are formed on top and bottom portions of an inner side surface of an outer periphery of the stopper 73. By the key-like projection 73*c* fitting into the cutout portion 25*b*3, the stopper 73 is restricted from rotating about an axis of the bearing ring 25*b*. FIG. 7 shows the key-like projection 73*c* of an upper side only.

An inner wall surface of the first annular projection 73*a* and an outer peripheral surface of the support pin 25*a* fit to each other. An outer peripheral surface of the second annular projection 73*b* and an inner wall surface of the bearing ring 25*b* also fit to each other. An inner side surface of the outer periphery of the stopper 73 is formed abuttable against a tip face of the cylindrical portion 71*a*1. In this way, the axle 71 is restricted from moving outward by the stopper 73. The sliding annular section 25*b*2 receives a weight of the backrest 70 via the cylindrical portion 71*a*1. Therefore the outer peripheral surface of the second annular projection 73*b* supports an inner wall surface of the sliding annular section 25*b*2, and the bearing ring 25*b* is reinforced by the first annular projection 73*a* and the support pin 73 fitting to each other. An axle cover 74 is installed over the stopper 73 from the outer side.

Figure 8:
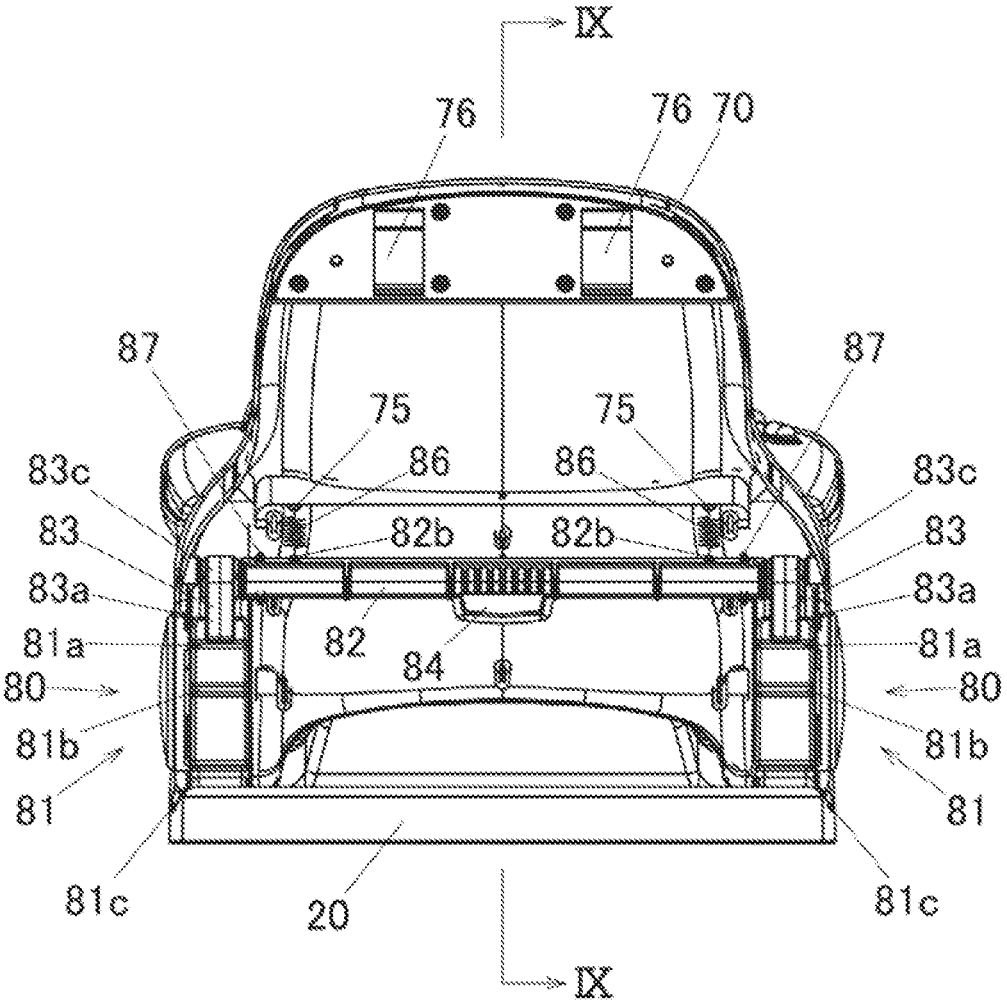
FIG. 8 is a rear view of the bath chair of the present invention showing a state in which a cover is removed.
Figure 9:
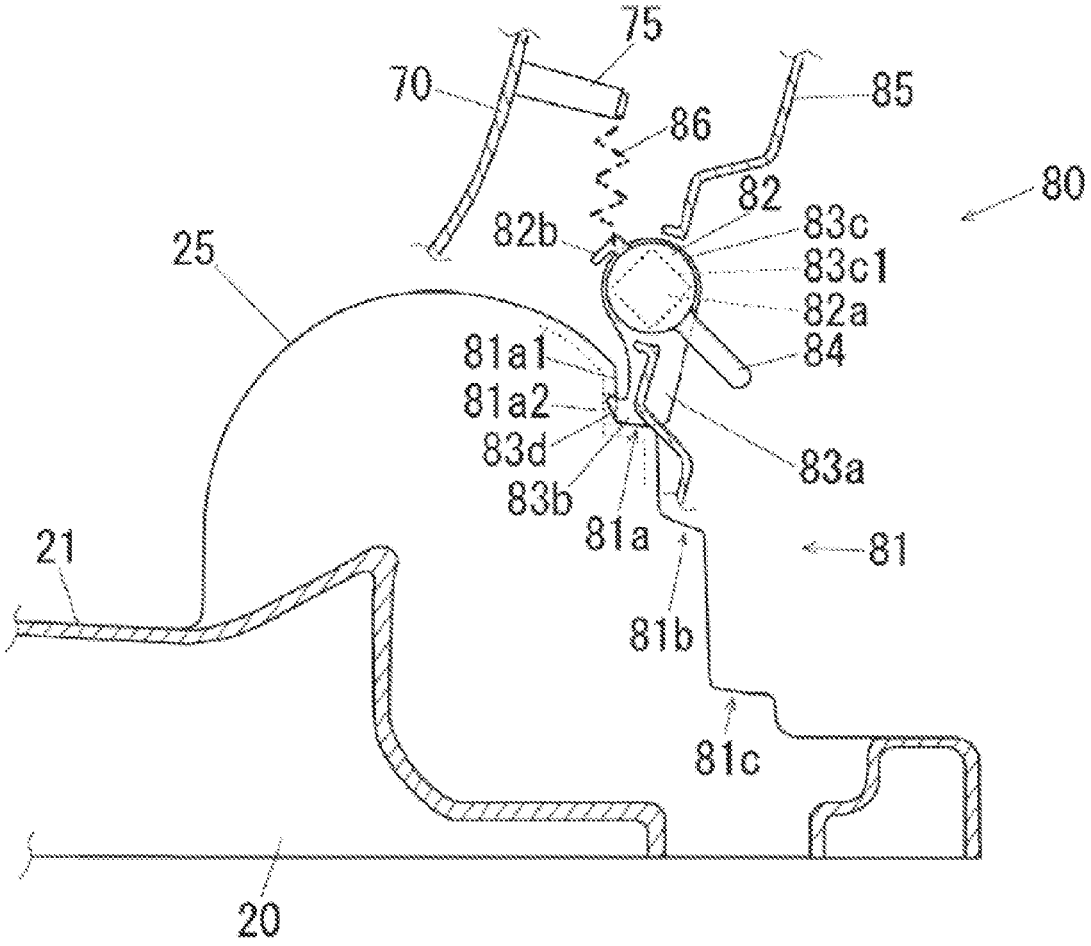
FIG. 9 is a cross-sectional view of a principal part of the bath chair of the present invention taken along line IX-IX of FIG. 8.

A reclining mechanism 80 will be described in detail with reference to FIGS. 8 and 9. FIG. 8 is a rear view of the bath chair showing a state in which a cover is removed, and FIG. 9 is a cross-sectional view with omitting some parts of the backrest 70, axle 71, and cover 85.

The operating shaft 82 is, as heretofore described, rotatably laid across the back face of the backrest 70. More specifically, portions adjacent to both left and right ends of the operating shaft 82 are rotatably supported by a bearing member formed by the back face of the backrest 70 and the cover 85. An annular rib 87 is formed on the operating shaft 82 so as to prevent lateral displacement of the operating shaft 82.

A step member 81 formed on a backside of the bearing member 25 of the base 20 includes a top step 81*a* and a bottom step 81*c*, and the both steps 81*a*, 81*c* are formed into flat surfaces. The middle step 81*b* is formed into an inclined surface which inclines downward toward rear direction. A latching hole 81*a*2 is provided to a front side wall surface 81*a*1 of the top step 81*a* so as to be a laterally extended rectangular hole when viewed from rear.

A square hole 83*c*1 is formed on a base part 83*c* of the abutment member 83. A prismatic projection 82*a* is formed at each left and right distal ends of the operating shaft 82 so as to project toward outer side. The prismatic projection 82*a* is pressed into the square hole 83*c*1, whereby the abutment member 83 is fixed to the operating shaft 82. An abutment part 83*a* is formed on the abutment member 83 so as to extend from the base part 83*c* to a direction intersecting a shaft center of the operating shaft 82 at a right angle. A flat portion 83*b* is formed on a distal end of the abutment part 83*a*. A latching projection 83*d* projecting toward front direction is formed on a distal end of the abutment part 83*a*. The latching projection 83*d* is formed so as to be inserted into the latching hole 81*a*2 to be latched.

Two elastic member locking projections 82*b* are disposed to left and right outer surfaces of the operating shaft 82, which project in a direction opposite to the lever 84. The elastic member locking projection 82*b* has a locking portion downwardly bent at a right angle. At least one elastic member locking pin 75 is disposed to the backside of the backrest 70 in a rearwardly standing manner. A coil spring 86, which is the elastic member, is provided between the each elastic member locking projection 82*b* and the elastic member locking pin 75. One end of the coil spring 86 is locked by the elastic member locking projection 82*b* and the other end of the coil spring 86 is locked by the elastic member locking pin 75. Consequently the operating shaft 82 is biased to a direction in which the lever 84 is pressed down (in other words, clockwise rotation in FIG. 9) by the coil spring 86. This means that the abutment member 83 is also biased clockwise in FIG. 9.

Consequently, in operation of the reclining mechanism 80 having the structure heretofore described, pulling up the lever 84 against the bias force of the coil spring 86 releases the abutment between the flat portion 83*b* of the abutment member 83 and the step member 81, whereby the backrest 70 can be adjusted its reclining angle. When the lever 84 is released from a hand, the flat portion 83*b* of the abutment member 83 abuts against any step of the step member 81, whereby the backrest 70 is fixed. In addition, when adjusting the backrest 70 to a raising direction, by simply raising the backrest 70 by hand, the flat portion 83*b* is moved to the next step of the step member 81 with a front distal end of the latching projection 83*d* contacting slidingly to the front side wall surface of each step of the step member 81, and then the flat portion 83*b* and the next step of the step member 81 abut against each other.

In the top step 81*a*, the latching hole 81*a*2 is provided to the front side wall surface 81*a*1 to be latched with the latching projection 81*a*2. The backrest 70 is restricted from folding forward by the latching projection 83*d* and the latching hole 81*a*2 latching with each other. In order to make the bath chair 10 into a storage condition as shown in FIG. 5 or 6, pulling up of the lever 84 releases the latching between the latching projection 83*d* and the latching hole 81*a*2, whereby the backrest 70 can be folded until it contacts the handle 40 or the protrusion 23. In this condition, the front distal end of the latching projection 83*d* abuts against a curved surface on an upper part of the bearing member 25.

By structuring the reclining mechanism 80 of the present invention as heretofore described, the backrest 70 can be adjusted its reclining angle by one lever 84, thereby be operated with ease. In addition, the reclining angle can be adjusted without operating the lever 84 when raising the backrest 70, whereby the reclining operation can be performed more easily. The backrest 70 is not be folded forward unintentionally since the forward folding of the backrest 70 is restricted by the latching between the latching hole 81*a*2 and the latching projection 83*d*.

A direction of force applied to the operating shaft 82 via the lever 84 when pulling up the lever 84 is a direction of a tangent line to a vertical section of the operating shaft 82. Therefore the operating shaft 82 can be rotated smoothly since the direction of the force applied to the operating shaft 82 and the direction of the rotation are the same. Durability of components is improved and this allows the reclining mechanism 80 to be used stably for a long period of time since undue force is not applied to the operating shaft 82.

In the step member 81, the top step 81*a* and the bottom step 81*c* are formed into flat surfaces, and the middle step 81*b* is formed into an inclined surface which inclines downward toward rear direction. The abutment member 83 is biased to be rotated forward by the coil spring 86 via the operating shaft 82. Accordingly, in a condition in which the lever 84 is released from the hand, the front distal end of the latching projection 83*d* of the abutment member 83 is always latched with the latching hole 81*a*2 at the top step 81*a*, and abuts against the front side wall surface at the steps 81*b* and 81*c*. This means that the flat portion 83*b* always abuts against any one of the steps of the step member 81.

When the latching projection 83*d* is superposed on the top step 81*a*, the flat portion 83*b* of the abutment member 83 is oriented downward as shown in FIG. 9. In addition, when the backrest 70 is lowered and the latching projection 83*d* is superposed on the middle step 81*b*, the operating shaft 82 is located at a position slightly rearward from a position of the middle step 81*b*. Further, when the latching projection 83*d* is superposed on the bottom step 81*c*, the operating shaft 82 is located at a position lower than a position of the axle 71, and above the step 81*c*. Accordingly, in the step member 81, a whole surface of the flat portion 83*b* always abuts against the surface of each step of the step member 81 since the top step 81*a* and the bottom step 81*c* are formed into flat surfaces, and the middle step 81*b* is formed into an inclined surface which inclines downward toward rear direction. Contact pressure of the flat portion 83*b* can thus be reduced, thereby reduces a damage possibility of the abutment member 83.

The invention is not limited to the embodiment that has been described heretofore but can be modified or improved variously without departing from the spirit and scope of the invention. For example, although the operating shaft 82 is biased by the coil spring 86, the operating shaft 82 can also be biased by a torsion coil spring that is wound around the operating shaft 82. In addition, the step member 81 is made up of three steps in this embodiment; however the step member 81 can also be made up of two steps, four steps, or more steps.

What is claimed is:

1. A bath chair comprising:

a base having a seat;

a backrest rotatably supported by left and right bearing members each protrudes from rear left and right sides of the base;

an operating shaft rotatably laid across a back face of the backrest;

a lever provided to the operating shaft;

an abutment member fixed on each end of the operating shaft having an abutment part extending orthogonally to the operating shaft;

an elastic member for energizing the operating shaft to a direction in which the lever is rotated downward; and a plurality of steps formed at a back side of each bearing member of the base so as to be abuttable against the abutment part of each abutment member.

2. The bath chair of the claim 1, further comprises:

a latching projection projecting toward front direction from the abutment part of each abutment member; and a latching hole formed on a front side wall surface of a topmost step of the plurality of steps so as to be latchable to the latching projection.

3. The bath chair of claim 1, wherein a flat portion is formed on a distal end of the abutment part of each abutment member, the each plurality of steps is made up of three steps, a top step, a middle step, and a bottom step, and the top step and the bottom step are formed into flat surfaces, and the middle step is formed into an inclined surface which inclines downward toward rear direction.

4. The bath chair of claim 2, wherein a flat portion is formed on a distal end of the abutment part of each abutment member, the each plurality of steps is made up of three steps, a top step, a middle step, and a bottom step, and the top step and the bottom step are formed into flat surfaces, and the middle step is formed into an inclined surface which inclines downward toward rear direction.

* * * * *